US006392199B1

(12) United States Patent
Endler et al.

(10) Patent No.: US 6,392,199 B1
(45) Date of Patent: May 21, 2002

(54) GLOW PLUG AND PROCESS FOR ITS MANUFACTURE

(75) Inventors: Max Endler; Martin Allgaier, both of Ludwigsburg; Michael Haussner, Benningen; Heinz-Georg Schmitz, Kirchberg; Ulf Wyrwich, Pleidelsheim; Reinhold Grebe, Affalterbach; Hans-Peter Kasimirski; Martin Eller, both of Ludwigsburg, all of (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 09/565,477

(22) Filed: May 5, 2000

(30) Foreign Application Priority Data

May 5, 1999 (DE) ..... 19920766

(51) Int. Cl.[7] ..... F23Q 7/00
(52) U.S. Cl. ..... 219/270; 123/145 A
(58) Field of Search ..... 219/270, 544; 123/145 A, 145 R

(56) References Cited

U.S. PATENT DOCUMENTS

| | | | | |
|---|---|---|---|---|
| 4,661,686 A | | 4/1987 | Yokoi et al. | |
| 5,626,781 A | * | 5/1997 | Schmidt et al. | 219/270 |
| 5,645,742 A | * | 7/1997 | Schmidt et al. | 219/270 |
| 6,215,105 B1 | * | 4/2001 | Simpkins et al. | 219/270 |
| 6,248,980 B1 | * | 6/2001 | Chiu et al. | 219/270 |
| 6,255,626 B1 | * | 7/2001 | Endler et al. | 219/270 |

FOREIGN PATENT DOCUMENTS

| | | | | |
|---|---|---|---|---|
| EP | 834652 | * | 4/1998 | |
| EP | 989370 | * | 3/2000 | |
| JP | 59-66618 | * | 4/1984 | 219/270 |
| JP | 59-167635 | * | 9/1984 | 219/270 |

* cited by examiner

*Primary Examiner*—John A. Jeffery
(74) *Attorney, Agent, or Firm*—Nixon Peabody LLP; David S. Safran

(57) ABSTRACT

A glow plug including a heating rod having a plug body composed of an electrically insulating plastic material, an inner pole connected to heating elements, and optionally, control elements, and an outer pole which is electrically insulated from adjoining components of the plug body by an insulative material provided between an inner and outer support tube, the inner support tube surrounding the heating rod while the plug body surrounds the outer support tube.

7 Claims, 13 Drawing Sheets

GLOW PLUG AND PROCESS FOR ITS MANUFACTURE

BACKGROUND OF THE INVENTION

1. Field of the Invention

The present invention relates generally to glow plugs which have a heating rod with an inner pole with glow and optionally control element(s), the heating rod being electrically insulated relative to the glow plug body, and a process for producing such glow plugs.

2. Description of the Related Art

Making glow plugs with a metal heating rod with an inside pole and with metal glow plug bodies such that, between the wall of the heating rod and the glow plug body, heat-resistant electrical insulation in the form of a glass seal is inserted is known from general practice. Here the metal glow plug body and the metal heating rod with their respective terminal as well as the glass tubes located between the glow plug body and the heating rod are inserted into a graphite mold and heated in a furnace until the glass melts. The terminals are electrically insulated from one another by ceramic tubes. After cooling and solidification of the molten glass the glow plug body is fixed insulated against the heating rod and the terminals. In this complex production process treatment must take place in a firnace, by which among others also the use of heat-resistant materials is necessary. Construction precision and operating quality cannot be easily ensured in this process, since during the process distortion of the components is possible. The technical effort of producing glow plugs of the type just described corresponds to the economic cost.

It has likewise been proposed that at least the heating rod be produced from ceramic material; in doing so, in a multistage production process for which special tools and devices are necessary, the ceramic must be shaped, compounded, fired and ground into the heating rod. In addition, the ceramic heating rod must be connected to a support tube and can only be built into a finished glow plug in conventional installation.

SUMMARY OF THE INVENTION

The object of the invention is to make available, while circumventing the disadvantages known from the related art, a glow plug which conventionally can be produced while avoiding special expensive and complex production processes, which makes available a relative large defined electrode, which has high construction precision and functional quality and especially in combined use for ion flow measurement leads to improved and more reliable measurement signals.

BRIEF DESCRIPTION OF THE DRAWINGS

FIG. 1(*b*) shows a sectional of the insulation of the glow plug of FIG. 1(*a*) in accordance with the present invention;

FIG. 2(*b*) shows a sectional of the insulation of the glow plug of FIG. 2(*a*) in accordance with the present invention;

FIG. 6(*b*) shows a sectional of the insulation of the glow plug of FIG. 6(*a*) in accordance with the present invention;

DETAILED DESCRIPTION OF THE PREFERRED EMBODIMENTS

Figures 1A, 1B:
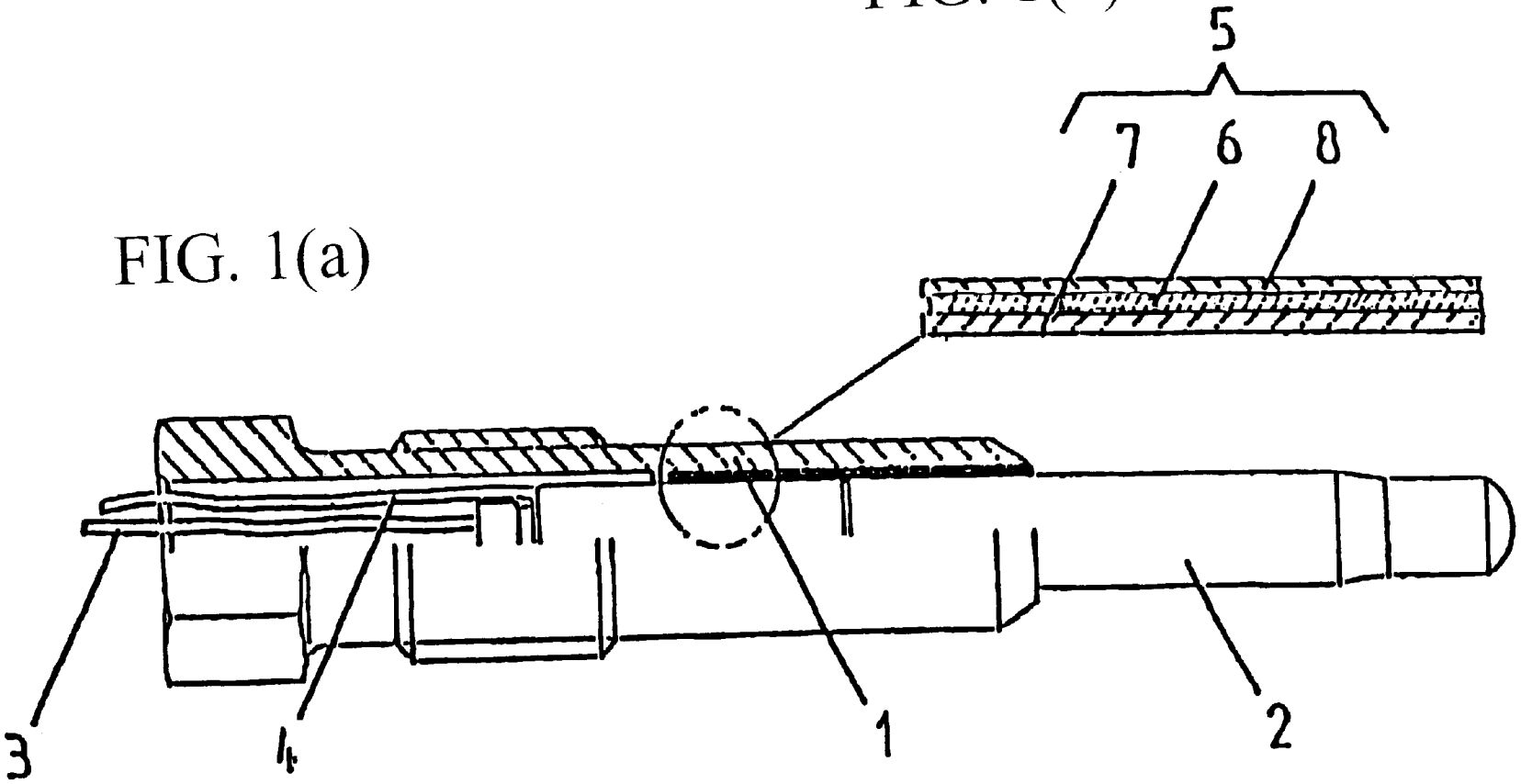
FIG. 1(*a*) shows a partial schematic longitudinal section through one embodiment of a glow plug in accordance with the present invention.

As shown in FIG. 1, the embodiment of the glow plug in accordance with the present invention which is shown has a conventional metal glow plug body 1 with a likewise conventional metal heating rod 2 which is provided conventionally with an inside inner pole (not shown) and heating and optionally control elements connected thereto.

In the force fit area of the body 1 on the heating rod 2 the insulation 5 is formed, this insulation consisting of an inner support tube 7 and an outer support tube 8, the inner support tube 7 surrounding the heating rod 2 as it adjoins it; between the support tube 7 and the support tube 8 which is located concentrically around it an electrically insulating material 6 in the form of a molding, a ceramic mass or an electrically insulating heat-resistant metal oxide such MgO is inserted. The body 1, in turn, concentrically surrounds the outer support tube 8 and adjoins the outer support tube 8.

The insulating material 6 is disposed between the two support tubes 7, 8, the insulation 6 being made in the form of an insulating sleeve 5 which is pressed into the body 1. Then the heating rod 2 is pressed into this insulating sleeve 5; alternatively, first the heating rod 2 can be pressed into the insulating sleeve 5 and then connected to the body 1 by reducing, rolling or drawing. The terminals 3, 4 with the inner pole or the wall of the heating rod are routed out of the terminal-side end area of the glow plug as cable connections.

Figures 2A, 2B:
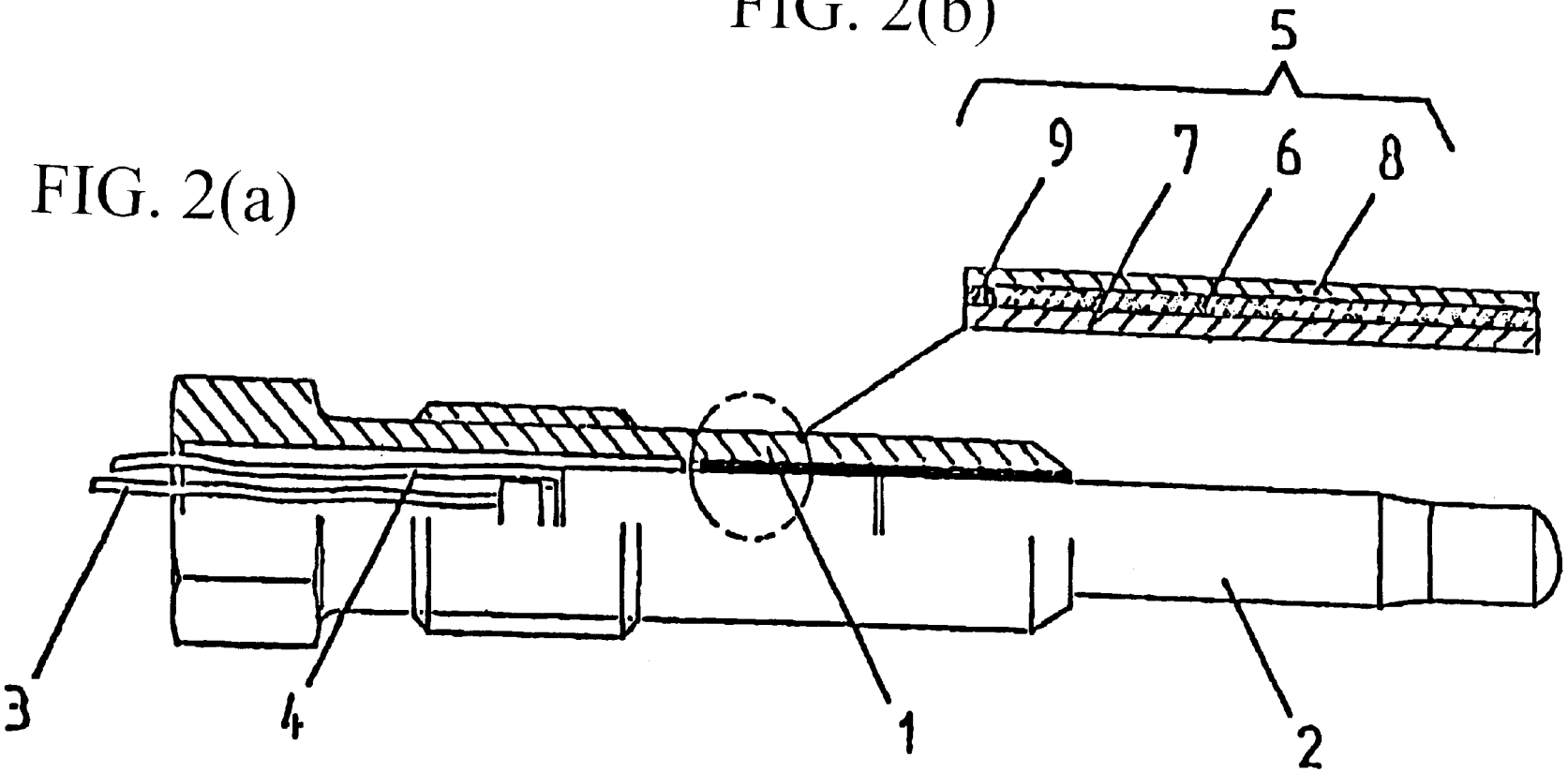
FIG. 2(*a*) shows a partially schematic longitudinal section of a second embodiment of a glow plug in accordance with the present invention.

The embodiment as shown in FIG. 2 corresponds essentially to the one shown in FIG. 1, however, in one or both end areas of the insulating sleeve 5 there being O-rings 9, for example, of silicone, as the seal, especially when using powdered insulating compound.

Figure 3:
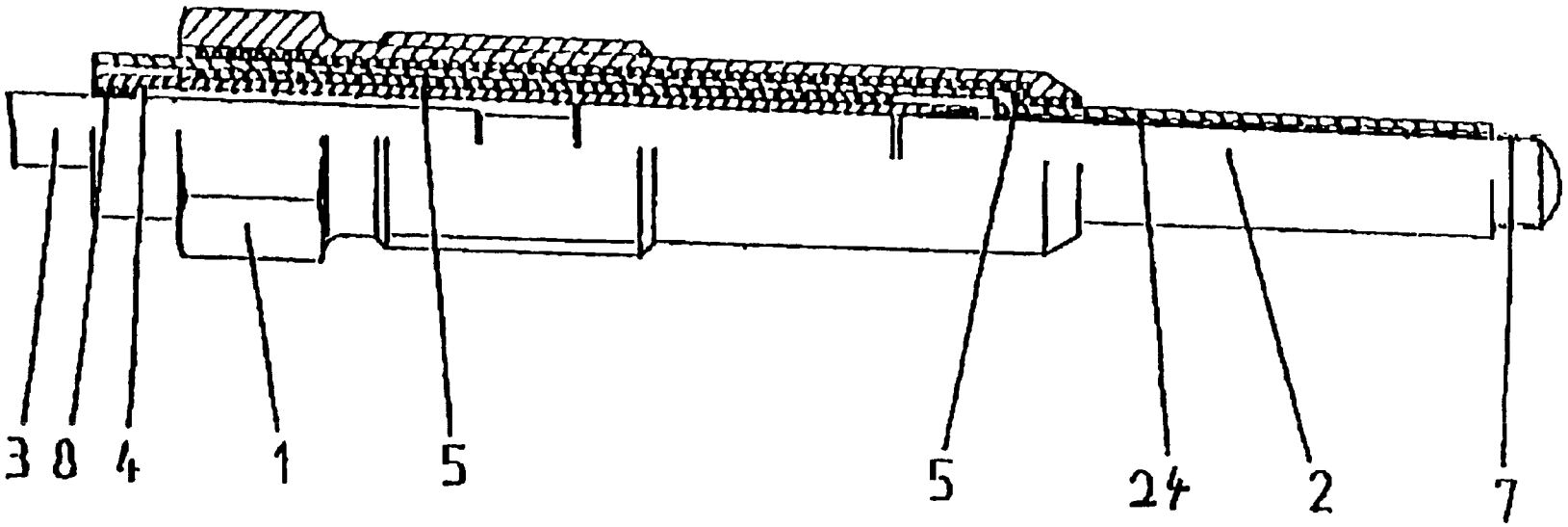
FIG. 3 shows a partially schematic longitudinal section of a glow plug in accordance with the present invention with a separate ion flow measurement sleeve.

The embodiment of the glow plug in accordance with the present invention as shown in FIG. 3 has a separate ion flow measurement sleeve 24 which projects into the combustion area and which is electrically insulated both against the body 1 by insulation 5 and also against the heating rod 2 by insulation 7. The connection of the wall of the heating rod 2 takes place via the terminal 4 in tubular form, one O-ring 8 insulating against the inner pole 3 and sealing the interior of the heating tube 2. The body 1 is fixed, for example, together with the ion flow measurement sleeve 24 and the tubular outer pole 4 in an injection molding tool, into which then insulating plastic material, for example, a suitable resin or thermoplastic is introduced so that it then represents in addition to mechanical fixing insulation 5 of the ion flow measurement sleeve 24 against the body 1 and also insulation 5 of the ion flow measurement sleeve 24 against the tubular outer pole 4. For this purpose the ion flow measurement sleeve 24 is perforated so that the plastic mass can penetrate into all areas and the enclosed air can escape. In addition, the heating rod 2 in the area of the contact surface to the ion flow measurement sleeve 24 is, for example, ceramically coated. The heating rod 2 can be securely joined via drawing, reducing or rolling into the ion flow measurement sleeve 24. Insulation of the ion flow measurement sleeve 24 relative to the heating rod 2 is ensured, for example, by the ceramic coating 7.

Figure 4:
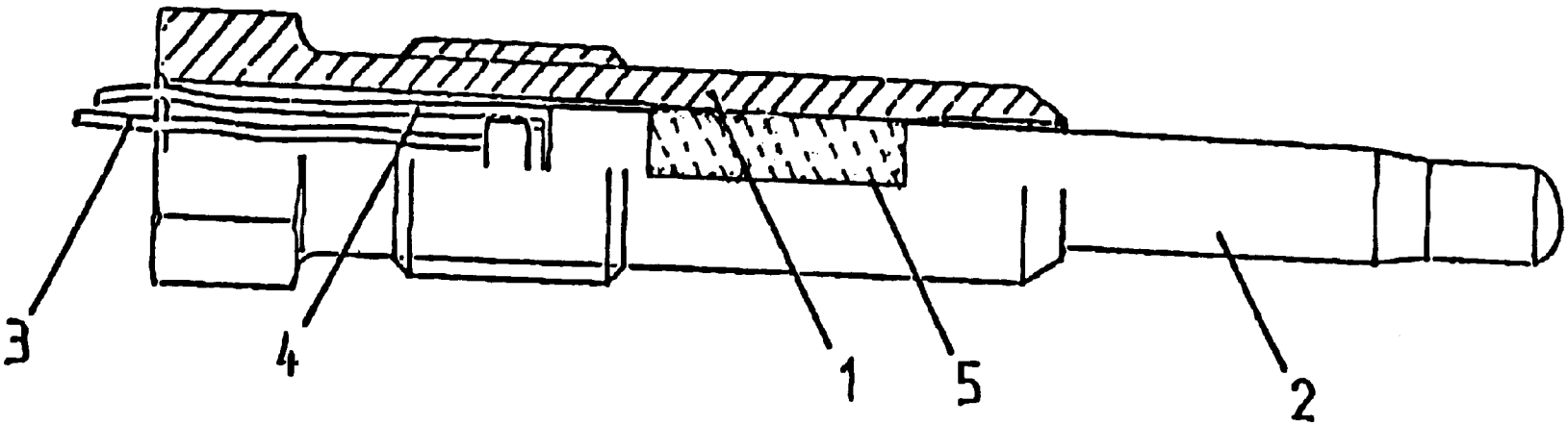
FIG. 4 shows a partially longitudinal section through another embodiment of the glow plug in accordance with the present invention.

Another embodiment in accordance with the present invention is shown in FIG. 4, the insulation 5 being made in a force fit area between the body 1 and the heating rod 2 as a ceramic coating, the heating rod 2 being conventionally pressed in or joined to the body 1 by reducing, drawing, or rolling.

Figure 5:
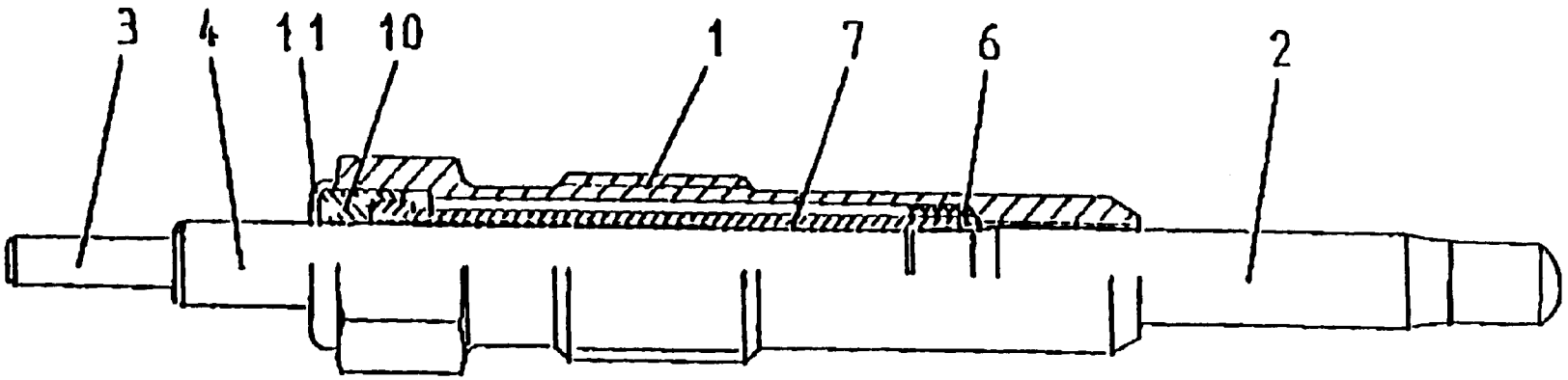
FIG. 5 shows a partially longitudinal section through another embodiment in accordance with the present invention.

FIG. 5 shows another embodiment in accordance with the present invention, an inner support tube 7 being provided which surrounds the heating rod 2 adjoining it, and in the contact area of the inner support tube 7 on the heating rod 2 the diameter of the heating rod is reduced in areas in order to increase the construction space for the other adjacent components. In this embodiment the insulating molding 6, preferably of ceramic, is inserted into the body 1, the heating rod 2 being pushed into the body 1 from the terminal side with the inner support tube 7 pressed on. To center and further insulate the components against one another a plastic molding 10 is slipped onto the heating rod 2 and pressed into the body 1. So that the heating rod 2 is securely anchored in the body 1, in the terminal-side end area there is a flanged ring 11 on the body 1 such that it presses the plastic molding 10 onto the heating rod 2 with the support tube 7 pressed on and presses the latter then onto the insulating molding 6 and the body 1. In this way the glow plug as claimed in the invention is sealed and insulated towards the body 1. The plugs are connected in turn via the terminals 3 and 4.

Figure 6A:
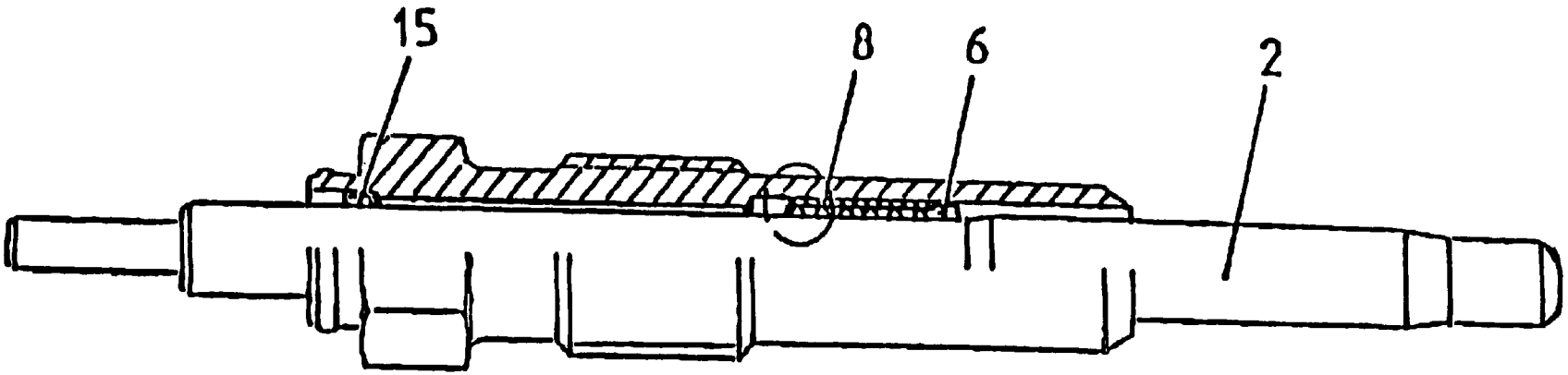
FIG. 6(*a*) shows a partially longitudinal section through another embodiment in accordance with the present invention.
Figure 6B:
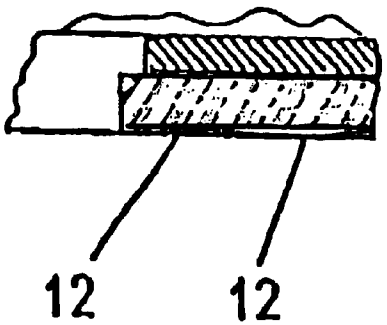

The further embodiment in accordance with the present invention as shown in FIG. 6 in the force fit area has an outer support tube 8, in this area as far as the terminal side end the diameter of the heating rod 2, as in the embodiment shown in FIG. 5, is decreased. The insulating molding 6 is soldered tight in the outer support tube 8 and on the heating rod with solder 12, preferably in a protective gas atmosphere or under a vacuum. The heating rod 2 with the components soldered on is then pressed into the body 1. A gasket 15 which has been applied in the terminal-side end area of the heating rod 2 seals the body 1 with simultaneous insulation of the heating rod 2 against the body 1.

Figure 7:
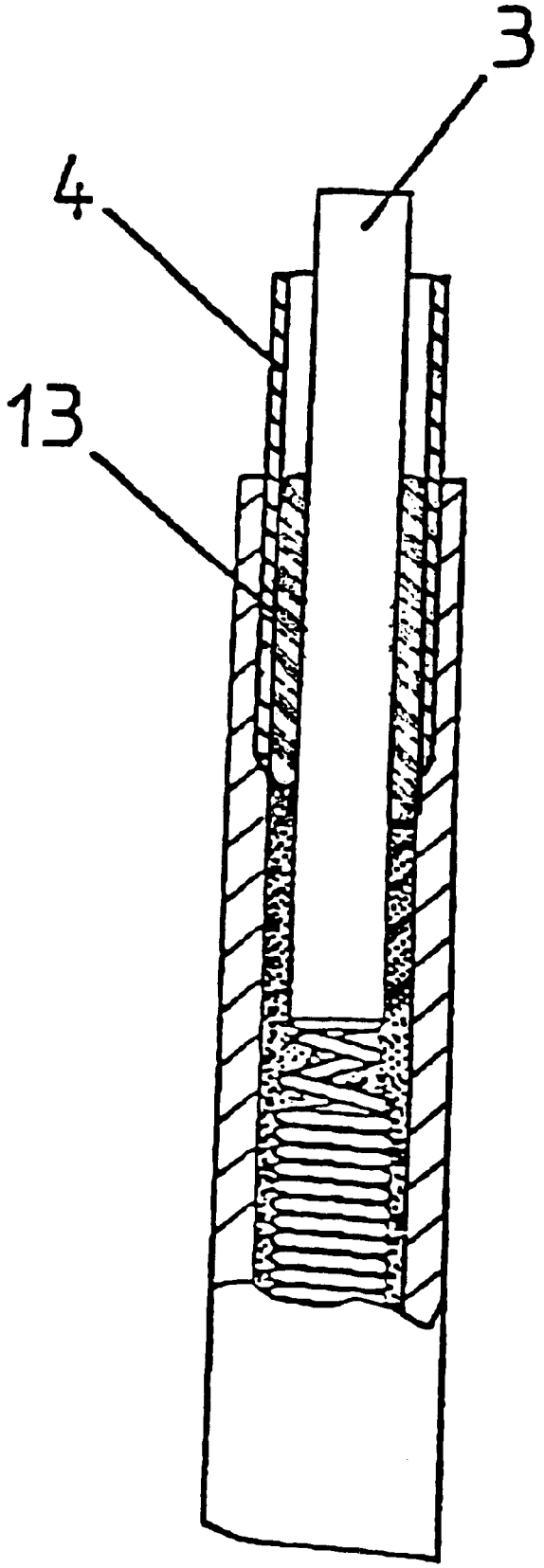
FIG. 7 shows a longitudinal section through the terminal-side end area of the heating rod of one embodiment of the glow plug in accordance with the present invention.

FIG. 7 shows a novel connection variation, especially for glow plugs in accordance with the present invention, in which connection of the heating rod 2 takes place via a contact tube 4, this contact tube 4 being inserted into a hole of the end area of the heating rod 2; to seal the interior of the heating rod 2 there is an O-ring 13 which together with the contact tube 4 is inserted or reduced in the terminal-side end area of the heating rod 2.

Figure 8:
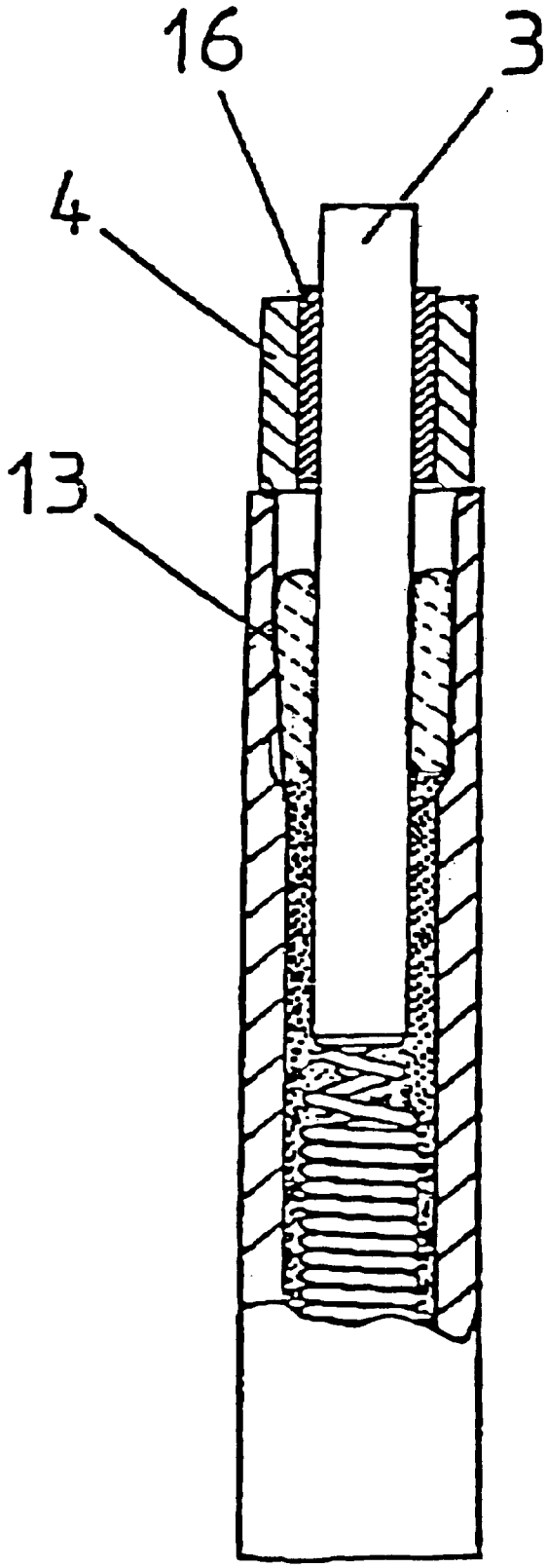
FIG. 8 shows a partially longitudinal section through the terminal-side end area of the heating rod of another embodiment of the glow plug in accordance with the present invention.

In another configuration of the heating rod termination in accordance with the present invention as shown in FIG. 8 a contact tube 4 is fixed concentrically on the end face of the terminal-side end area of the heating rod 2, for example by pulse welding; between the contact tube 4 and the inner pole 3 there is insulation 16 in the form of an insulating tube or an insulating compound, for example, MgO; the O-ring 13, in turn, insulates and fixes the inner pole 3 relative to the heating rod 2 and at the same time seals the interior of the heating rod 2.

Figure 9:
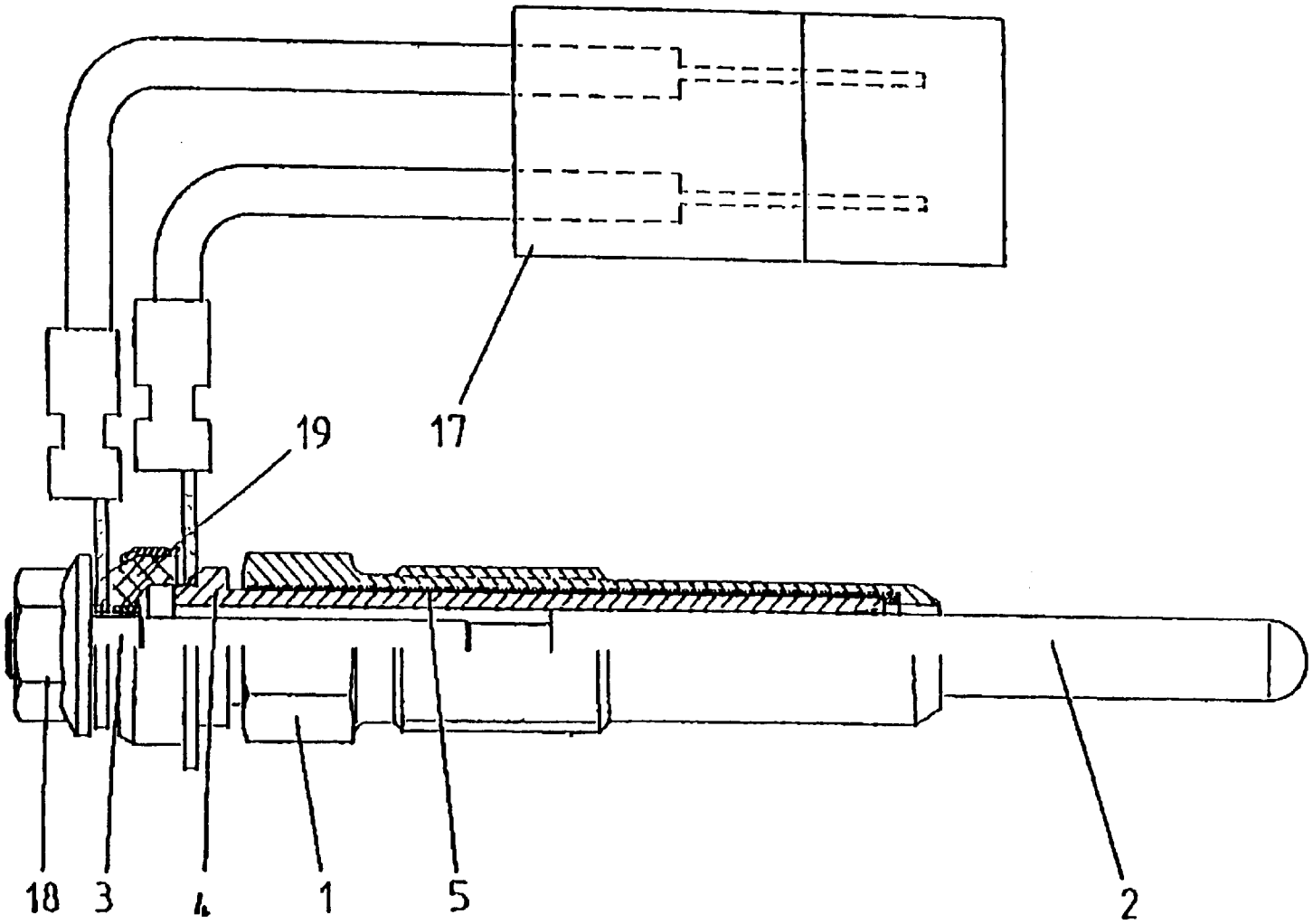
FIG. 9 shows schematic of the terminal area of another embodiment in accordance with the present invention.

As shown in FIG. 9, via the screw connection 19 which has already been used in series and which is attached to the nut 18 a double-pin or multipin plug 17 can be connected to a glow plug in which the connection of the inner pole 3 like a conventional inner pole is made with a threaded termination and the connection of the heating rod 2 is made as a metal tube which projects over the body 1 with a collar.

Figure 10:
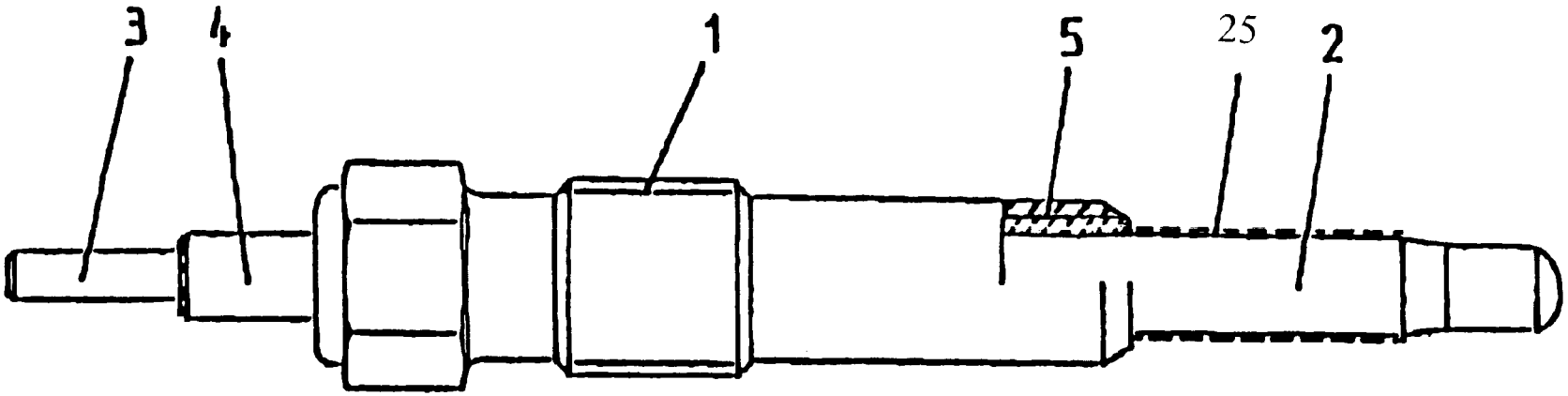
FIG. 10 shows a partial cross section through another embodiment of the glow plug in accordance with the present the invention.

As shown in FIG. 10, another embodiment of the glow plug in accordance with the present invention has an insulating, heat-resistant layer 24, for example, of ceramic, in the area of the part of the heating rod 2 which projects into the combustion space and preferably adjoins the insulation 5 between the heating rod 2 and the body 1. But this layer does not overlap the tip of the heating rod, for example, over an area of roughly 5 to 10 mm, to the extent it forms the actual ignition area. This results in that the danger of shunting is prevented by reduced or prevented soot formation on the temperature-resistant insulating layer 24. Measurement signals, for example, with respect to the ion flow, can be taken via the cylinder head from the uninsulated tip area of the heating rod 2 which forms the actual ignition area; in this area the soot is burned off as a result of the ambient temperature or the temperature of the heating rod during glow operation.

Figure 11:
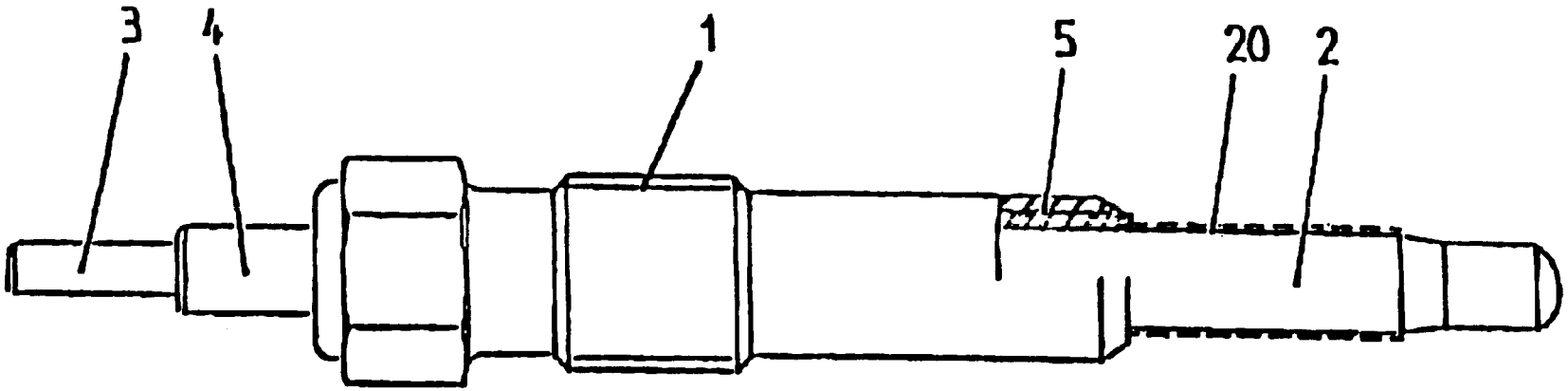
FIG. 11 shows a partial cross section through another embodiment of the glow plug in accordance with the present invention.

In the corresponding manner as in the embodiment shown in FIG. 10, in the embodiment shown in FIG. 11, instead of the ceramic layer 24, a catalytic layer 20 is applied which catalyzes the burn-off of the soot layer in this area of the heating rod with a lower temperature; suitable components of one such catalytic layer 20 can be platinum or palladium or their heat-resistant compounds or alloys.

Figure 12:
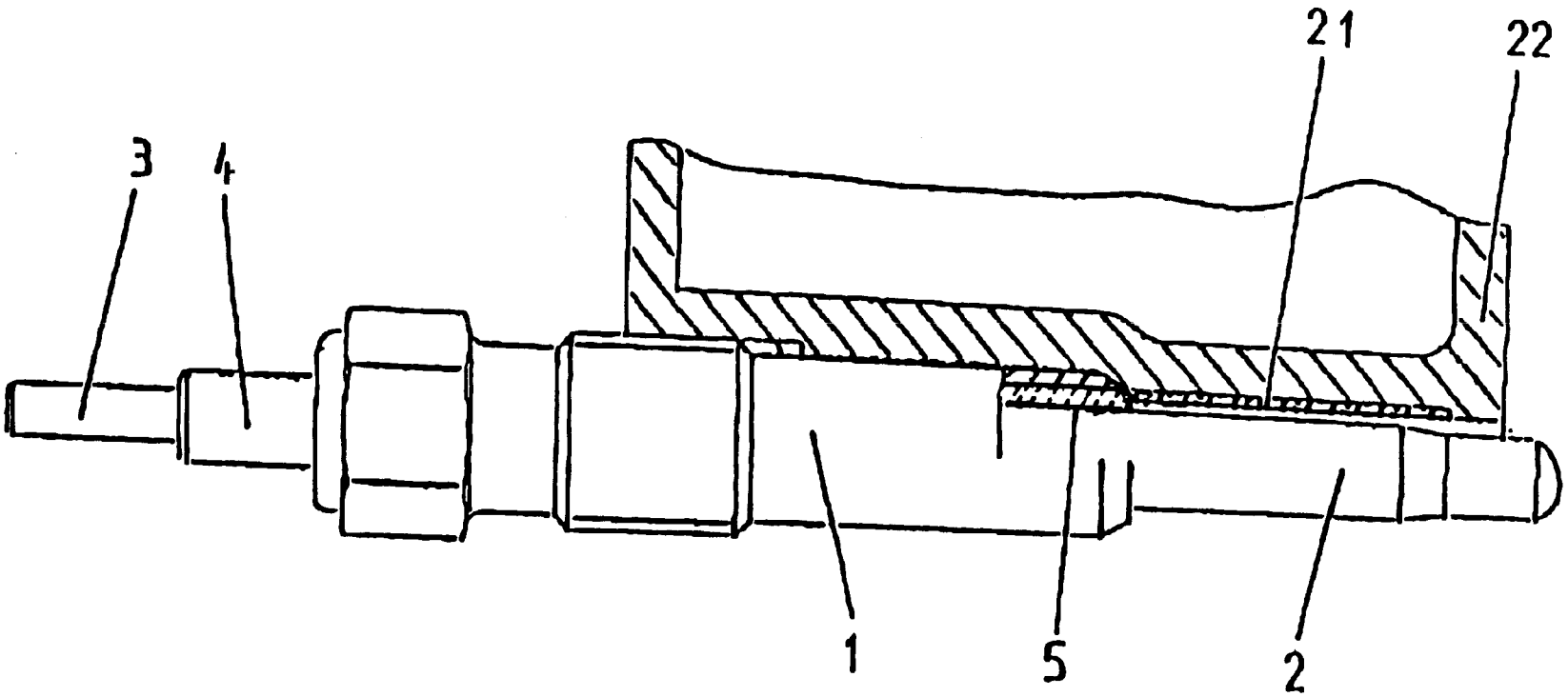
FIG. 12 shows a schematic partially longitudinal section through one arrangement with the glow plug in accordance with the present invention.

In FIG. 12 an arrangement is shown in which a glow plug in accordance with the present invention is inserted into a hole in the cylinder head which is provided with an insulating layer or an insulating ceramic tube 21 which is opposite the area of the heating rod 2 which is described in FIGS. 10 and 11 and which is endangered by soot deposition as a result of the lower temperatures of this area of the heating rod.

Figure 13:
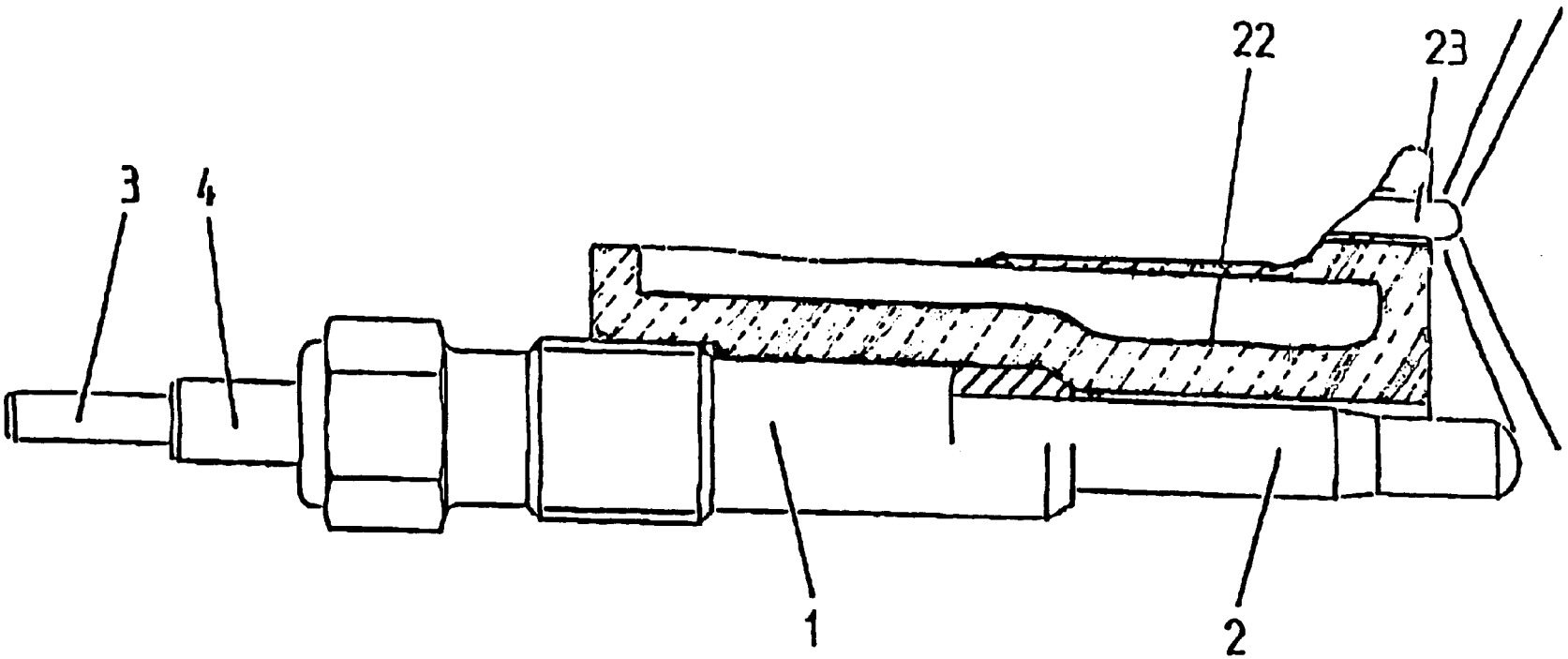
FIG. 13 shows through another arrangement with the glow plug in accordance with the present invention.

Another arrangement in accordance with the present invention as shown in FIG. 13 has a glow plug located in a cylinder head of ceramic or another insulating temperature-resistant material and the ion flow can be measured, for example, between the heating rod 2 and the injector 23.

The advantages in accordance with the present invention consist in the simple production process which is suitable for mass production and into which the production conventional to date can be integrated. The glow plugs in accordance with the present invention are characterized by small deviations of shape and bearing of the components, especially of the inner pole, and the different components and construction materials such as the sealing components and insulating compounds can be adapted to the various operating temperatures of the respective glow plug area. At the same time, the glow plugs in accordance with the present invention in their combustion space-side area make available an insensitive, large-area electrode, and more accurate and more reliable ion flow measurement signals can be attained. At the same time, the tubularly made coaxial connections allow simple terminals, especially of the inner pole.

What is claimed is:

1. Glow plug with a heating rod, having an inner pole and having an outer pole each of which is connected to a terminal lead, the outer pole being the wall of the heating rod which is electrically insulated from the adjacent components of the plug body, characterized in that the electrical insulation in a force fit area between the plug body and the heating rod is made in the form of a thin ceramic coating on the heating rod or on the interior wall of a hole of the plug body adjoining the heating rod.

2. Glow plug as claimed in claim 1, wherein the terminal-lead electrical connection to the wall of the heating rod is a tubular outer pole one end of which is contacted with the wall of the heating rod, and further comprising an O-ring sealing the interior of the heating rod and at the same time electrically insulating the tubular outer pole against the inner pole.

3. Glow plug as claimed in claim 2, wherein the tubular outer pole in the terminal-lead area of the heating rod is fixed by spot welding and is electrically insulated relative to the inner pole, which extends through the tubular outer pole, by injected electrically insulating material.

4. Glow plug as claimed in claim 1, wherein a separate ion flow measurement sleeve is provided concentrically around the area of the heating rod projecting into a combustion space, such that the sleeve is insulated both against the plug body and also against the heating rod, and wherein insulation against the heating rod in the contact area of the ion flow measurement sleeve is a ceramic.

5. Glow plug as claimed in claim 1, wherein the area of the heating rod projecting into a combustion space, exclusive of a tip of the heating rod which functions as the ignition area, is coated with a heat-resistant electrical insulating material.

6. Glow plug as claimed in claim 5, wherein the heat-resistant electrical insulating material is a ceramic.

7. Glow plug as claimed in claim 1, wherein the area of the heating rod projecting into a combustion space, exclusive of a tip of the heating rod which functions as the ignition area, is provided with a layer of catalytic material for preventing a layer of soot.

* * * * *